US008434308B2

(12) United States Patent
Booth et al.

(10) Patent No.: US 8,434,308 B2
(45) Date of Patent: May 7, 2013

(54) HEAT PIPES FOR TRANSFERRING HEAT TO AN ORGANIC RANKINE CYCLE EVAPORATOR

(75) Inventors: Charles Michael Booth, Norcross, GA (US); Larry William Swanson, Laguna Hills, CA (US); Robert Warren Taylor, Ponte Vedra Beach, FL (US)

(73) Assignee: General Electric Company, Schenectady, NY (US)

( * ) Notice: Subject to any disclaimer, the term of this patent is extended or adjusted under 35 U.S.C. 154(b) by 720 days.

(21) Appl. No.: 12/559,774

(22) Filed: Sep. 15, 2009

(65) Prior Publication Data

US 2011/0061386 A1 Mar. 17, 2011

(51) Int. Cl.

| | |
|---|---|
| ***F01K 25/08*** | (2006.01) |
| ***F01K 25/00*** | (2006.01) |
| ***F28D 15/00*** | (2006.01) |

(52) U.S. Cl.

USPC ..... 60/651; 60/671; 165/104.26

(58) Field of Classification Search ..... 60/614–624, 60/645–682; 165/104.11–104.34

See application file for complete search history.

(56) References Cited

U.S. PATENT DOCUMENTS

| | | | | |
|---|---|---|---|---|
| 3,937,017 | A * | 2/1976 | Beschorner et al. | 60/516 |
| 4,303,122 | A * | 12/1981 | Powell | 165/285 |
| 4,426,959 | A * | 1/1984 | McCurley | 122/33 |
| 4,482,004 | A * | 11/1984 | Grover | 165/47 |
| 4,621,681 | A * | 11/1986 | Grover | 165/47 |
| 5,664,414 | A | 9/1997 | Bronicki et al. | |
| 6,132,823 | A * | 10/2000 | Qu | 428/34.6 |
| 6,332,321 | B1 | 12/2001 | Bronicki et al. | |
| 6,598,397 | B2 * | 7/2003 | Hanna et al. | 60/651 |
| 6,911,231 | B2 * | 6/2005 | Qu | 427/190 |
| 6,981,377 | B2 | 1/2006 | Vaynberg et al. | |
| 7,220,365 | B2 * | 5/2007 | Qu et al. | 252/70 |
| 2002/0148225 | A1 | 10/2002 | Lewis | |
| 2008/0011161 | A1 | 1/2008 | Finkenrath et al. | |
| 2008/0104938 | A1 | 5/2008 | Finkenrath et al. | |

FOREIGN PATENT DOCUMENTS

WO 2008044008 A2 4/2008

* cited by examiner

*Primary Examiner* — Kenneth Bomberg
*Assistant Examiner* — Christopher Jetton
(74) *Attorney, Agent, or Firm* — Cantor Colburn LLP

(57) ABSTRACT

A first portion of each of a plurality of Qu-type heat pipes is disposed in a hot gas path, and a second portion of each of the plurality of Qu-type heat pipes disposed away from the hot gas path. Also, the first portion of each of the plurality of Qu-type heat pipes extracts heat from the hot gas path and wherein the second portion of each of the plurality of Qu-type heat pipes creates a vapor that exits each second portion of the plurality of Qu-type heat pipes and away from the hot gas path.

14 Claims, 3 Drawing Sheets

HEAT PIPES FOR TRANSFERRING HEAT TO AN ORGANIC RANKINE CYCLE EVAPORATOR

BACKGROUND OF THE INVENTION

The subject matter disclosed herein relates to Rankine cycle systems and, in particular, to arrangements of heat pipes for transferring heat from a waste heat source to an organic Rankine cycle evaporator.

Organic Rankine cycle ("ORC") systems typically utilize working fluids (e.g., pentane, ammonia, etc.) with relatively low evaporation and condensation temperatures (i.e., lower than water). Such non-water systems allow for transforming heat (e.g., waste heat) from relatively lower temperature sources into useful work, for example, rotary power to drive generators. Sources of available low-temperature waste heat include the exhausts of coal-fired boilers (e.g., exhaust flows located upstream of a wet scrubber), cement and other kiln exhausts, glass furnaces, and other continuous industrial thermal processes. One alternative is to place the evaporator of the ORC system directly in the hot gas path. Another is to use a hot oil loop, with the hot oil exchanger located in the hot gas path.

However, the installation of heat exchangers directly in the hot gas paths of ORC systems poses concerns for flammability and/or toxicity of organic working fluids in the event of leaks in the heat exchanger. Also, the use of hot oil loops that heat the oil via a heat exchanger in the hot gas path and evaporate the ORC working fluid in an external heat exchanger is commonly found in various industrial usages, but is relatively expensive and involves installation of relatively heavy components.

BRIEF DESCRIPTION OF THE INVENTION

According to one aspect of the invention, a first portion of each of a plurality of Qu-type heat pipes (described in detail hereinafter) is disposed in a hot gas path, and a second portion of each of the plurality of Qu-type heat pipes disposed away from the hot gas path. Also, the first portion of each of the plurality of Qu-type heat pipes extracts heat from the hot gas path and wherein the second portion of each of the plurality of Qu-type heat pipes creates a vapor that exits each second portion of the plurality of Qu-type heat pipes and away from the hot gas path.

According to another aspect of the invention, a heat pipe evaporator includes a first portion of a Qu-type heat pipe disposed in a hot gas path, and a second portion of a Qu-type heat pipe disposed away from the hot gas path. Also, the Qu-type heat pipe extracts heat from the hot gas path and creates a vapor that exits the second portion of the Qu-type heat pipe and away from the hot gas path. Further, the second portion of the Qu-type heat pipe includes a plurality of fins connected with the second portion of the Qu-type heat pipe, wherein an outer portion of each fin is disposed next to a cover having corresponding holes formed therein, wherein each hole receives a portion of each corresponding outer portion of each fin, wherein each corresponding hole includes an extension region not occupied by the corresponding fin through which a working fluid passes and becomes the vapor as it is heated by the second portion of the Qu-type heat pipe.

According to another aspect of the invention, apparatus for extracting heat from a flow of waste heat, the apparatus includes a heat source having a plurality of Qu-type heat pipes arranged in a hot gas path of a waste heat source, wherein the first portion of each of the plurality of Qu-type heat pipes extracts heat from the hot gas path. The apparatus also includes an evaporator disposed apart from the heat source, wherein the evaporator comprises a plurality of Qu-type heat pipes, and a connector Qu-type heat pipe that connects the heat source with the evaporator, wherein the connector Qu-type heat pipe transfers the extracted heat from the heat source to the evaporator for evaporation thereby.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
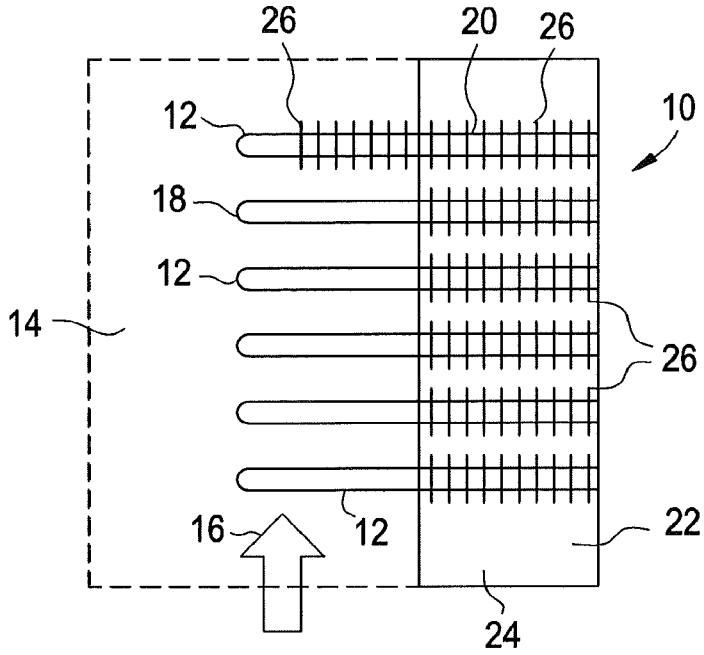
FIG. 1 is a diagram of an arrangement of a plurality of Qu-type heat pipes in accordance with an embodiment of the invention.

In FIG. 1 is an arrangement 10 of a plurality of heat pipes 12 in accordance with an embodiment of the invention. The heat pipes 12 extract heat from a hot gas path; for example, the waste heat from the exhaust of a coal-fire boiler. Other sources of waste heat may be utilized with embodiments of the invention, such as cement and other kiln exhausts, glass furnaces, and other continuous industrial thermal processes. The waste heat may flow in ductwork 14 or along some other bounded or unbounded path in an upward direction, as indicated by arrowhead 16. This ductwork 14 in which the waste heat flows may be considered as the hot gas path. In the alternative, the waste heat may flow downward through the ductwork 14 or in some other direction through ductwork 14 arranged in that other direction. A number of heat pipes 12 are shown in the arrangement 10 of FIG. 1. Each heat pipe 12 has a left hand end portion 18 disposed in the hot gas path of the ductwork 14 and a right hand end portion 20 disposed in a pressurized portion 22 of an evaporator 24 that may be part of a larger evaporator which itself is part of an overall organic Rankine cycle ("ORC") system. The pressurized portion 22 of the evaporator 24 is set apart or walled off from the ductwork 14. The ORC system may be utilized for any number of purposes that should be apparent to one of ordinary skill in the art. The right hand end portion 20 of each heat pipe 12 may be disposed or located in something other than a pressurized portion of an evaporator.

The right hand end portion 20 of each heat pipe 12 in the arrangement 10 shown in the embodiment of FIG. 1 may have a number of fins 26 formed integral with that heat pipe portion 20. The fins 26 on the right hand end portion 20 facilitate the transfer of waste heat flowing in the ductwork 14 out of the right hand end portions 18 of the heat pipes 12 and into the pressurized portion 22 of the evaporator 24. Also, the left hand end portion 18 of one or more of the heat pipes 12 may also incorporate the fins 26 to facilitate the transfer of heat from the waste heat flowing in the ductwork 14 and into the left hand end portion 18 of the heat pipes 12.

In an embodiment, the heat pipes 12 in the arrangement 10 of the embodiment shown in FIG. 1 comprise Qu-type heat pipes, described in detail hereinafter. In general, traditional liquid/vapor type heat pipes 12 operate by evaporative cooling to transfer thermal energy from one end 18 of the heat pipe 12 to another end 20 of the heat pipe 12 by the evaporation and condensation of a working fluid or other coolant materials. Heat pipes 12 rely on a temperature difference between the ends of the pipe 18, 20, and cannot lower temperatures at either end beyond the ambient temperature; thus, they tend to equalize the temperature within the pipe 12.

In general, there are two types of heat pipes 12. One is the more traditional liquid-vapor type and the other is the solid-state, inorganic coated heat pipe (e.g., a Qu-type heat pipe). For liquid-vapor types of heat pipes 12, when one end 18 of the sealed heat pipe 12 is heated, the working fluid inside the pipe 12 at that end 18 evaporates and increases the vapor pressure inside the cavity of the heat pipe 12. The working fluid may comprise water, ethanol, acetone, sodium, mercury, etc. The vapor flows to the second end 20 of the pipe 12 where it condenses, which releases the heat that originally caused the fluid to evaporate into an area (e.g., into the pressurized portion 22 of the evaporator 24). The latent heat of evaporation absorbed by the vaporization of the working fluid reduces the temperature at the hot end of the pipe 12. This vaporization and condensation process tends to create a continuous flow of the fluid material within the heat pipe 12, which efficiently transfers heat from the first end portion 18 of the pipe 12 to the second end portion 20 of the pipe 12.

Qu-type heat pipes are a type of solid-state heat pipe 12, which operate somewhat similarly to liquid-vapor type heat pipes 12 but do not use a fluid-vapor material to transfer heat from one end 18 of the pipe 12 to the other end 20 of the pipe 12. In a Qu-type heat pipe 12, the inner surfaces of the pipe 12 are coated with a relatively high heat conducting, inorganic material. In a Qu-type heat pipe, the internal heat transfer material comprises three basic layers. The first layer includes various combinations of sodium, beryllium, a metal such as manganese or aluminum, calcium, boron and dichromate radical. The second layer is formed over the first layer and includes various combinations of cobalt, manganese, beryllium, strontium, rhodium, copper, beta-titanium, potassium, boron, calcium, a metal such as manganese or aluminum and a dichromate radical. The third layer is formed over the second layer and includes various combinations of rhodium oxide, potassium dichromate, radium oxide, sodium dichromate, silver dichromate, monocrystalline silicon, beryllium oxide, strontium chromate, boron oxide, beta-titanium and a metal dichromate, such as manganese dichromate or aluminum dichromate. The three layers can be applied to a conduit and then heat polarized to form a heat transfer device that transfers heat without any net heat loss, or can be applied to a pair of plates having a small cavity relative to a large surface area to form a heat sink that can immediately disperse heat from a heat source.

Vapor is then removed from within the pipe 12 to create a vacuum inside the pipe 12. The pipe 12 is then sealed. The heat conducting Qu material coated on the inner surfaces of the heat pipe 12 transfers heat from one end 18 of the pipe 12 to the other end 20 of the pipe 12. Qu-type heat pipes 12 can provide for improved transfer of heat from one end to the other than more traditional liquid-vapor types of heat pipes 12 due to the relatively high thermal conductivity of the Qu material. Also, Qu-type heat pipes offer relatively greater axial heat fluxes as compared to other types of heat pipes. Thus, Qu-type heat pipes allow for the realization of embodiments of the invention that the more traditional liquid/vapor type heat pipes do not.

Figure 2:
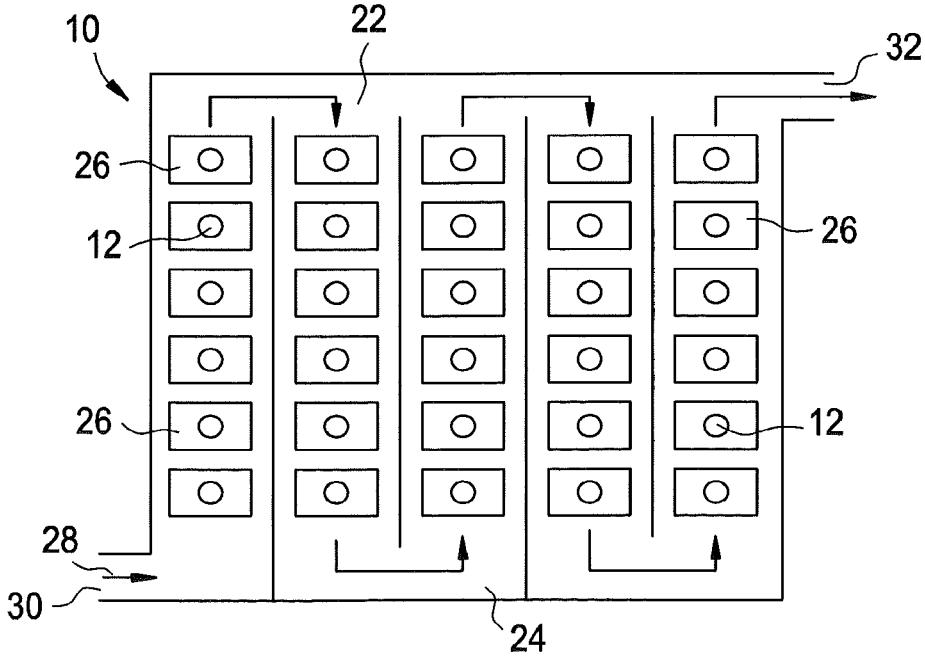
FIG. 2 is another diagram of the arrangement of Qu-type heat pipes of FIG. 1.

In FIG. 2 is another view of the arrangement 10 of the plurality of Qu-type heat pipes 12 of the embodiment of FIG. 1. The view in FIG. 2 is that looking from right to left in FIG. 1. From FIG. 2 it can be seen that the arrangement 10 of heat pipes 12 in FIG. 1 comprises a plurality of Qu-type heat pipes 12 in a three-dimensional arrangement 10. However, other arrangements are contemplated by various embodiments. In FIG. 2, the pressurized portion 22 of the evaporator 24 has the heat pipes 12 arranged in a serpentine-type manner in that a working fluid 28 enters the pressurized portion 22 through at least one inlet 30. The working fluid 28 flows through the arrangement 10 of FIG. 2 in an up and down manner through the passages formed in the pressurized portion 22 therein and exits the pressurized portion 22 through an outlet 32. As the working fluid 28 traverses the passages in the pressurized portion 22, the working fluid 28 passes by each of the right hand portions 20 of the corresponding Qu-type heat pipes 12. As it does so, the working fluid 28 is heated by the heat generated at the right hand end portion 20 of each heat pipe 12 and vaporizes. Thus, the working fluid 28 at the outlet 32 is in the form of a vapor having a temperature that is greater than or equal to the saturation or bubble point temperature of the working fluid 28 at the outlet 32.

Embodiments of the invention contemplate arrangements 10 of the Qu-type heat pipes within the pressurized portion of an evaporator other than the serpentine arrangement. For example, the Qu-type heat pipes 12 may be arranged in individual singular rows or columns in a three-dimensional arrangement with a corresponding inlet 30 and outlet 32 for each row or column. In addition, an embodiment in which only a single row or column of Qu-type heat pipes 12, instead of a three-dimensional arrangement, may be contemplated.

Figure 3:
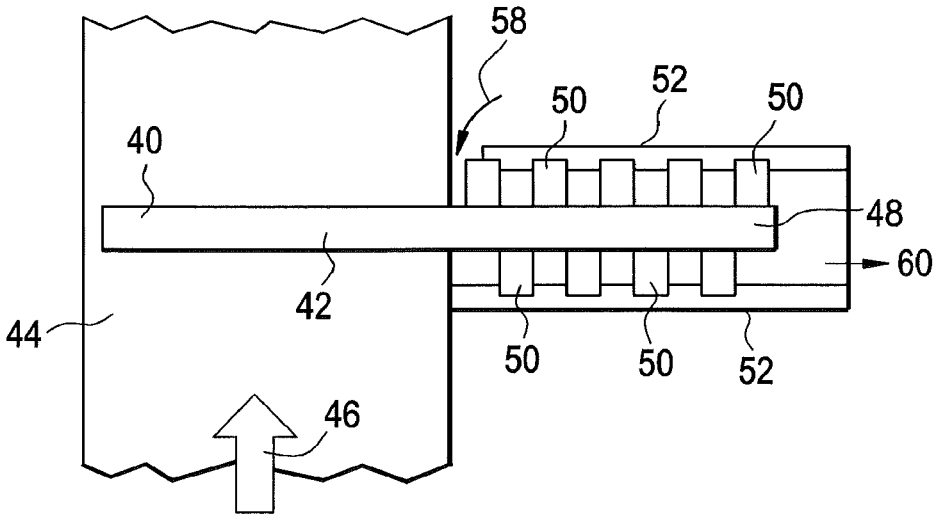
FIG. 3 is a diagram of a Qu-type single heat pipe according to another embodiment of the invention.
Figure 4:
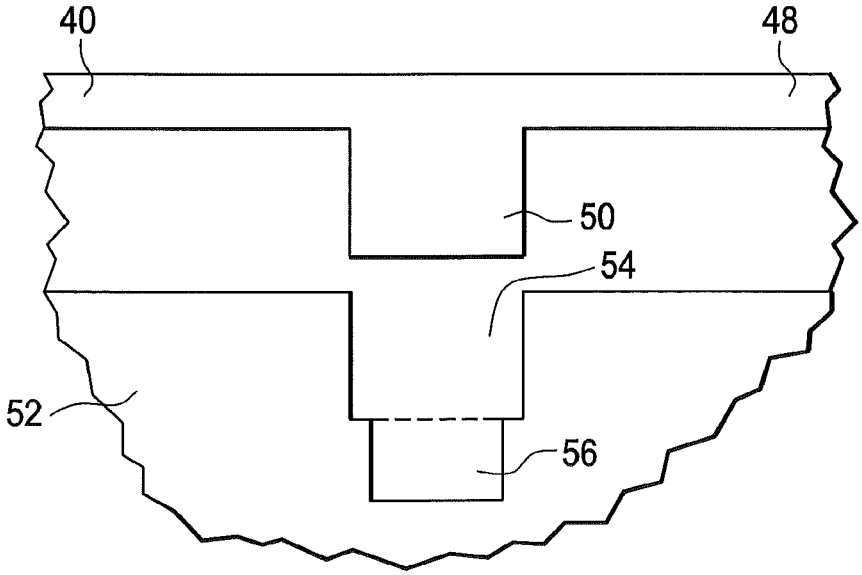
FIG. 4 is a more detailed diagram of the Qu-type heat pipe of the embodiment of FIG. 3.

In FIG. 3 is a singular Qu-type heat pipe 40 having a left end portion 42 disposed in ductwork 44 in which waste heat flow upwards, as indicated by the arrowhead 46. Again, however, the waste heat may flow downwards instead in the ductwork 44 or in some other direction in which the ductwork 44 is oriented. In this embodiment, the right hand end portion 48 of the Qu-type heat pipe 40 may have a number of fins 50 formed integral with or connected with the right hand end portion 40. The fins 50 may be formed in a staggered pattern as shown in FIG. 3, similar to a thread formed on a screw (that is, in a single, continuous, spiral screw thread-like arrangement). A cover 52 encloses the fins 50. As seen in more detail in cross-section in FIG. 4, the cover 52 includes holes 54 that correspond to the locations of the fins 50. FIG. 4 illustrates the right hand end portion 48 of the heat pipe 40 in a position that is away from its normal position in which the fin 50 engages within the corresponding hole 54 in the cover 52. FIG. 4 also shows that a counter sunk hole 56 is formed farther into the cover 52 for each of the holes 54. When the fins 50 are engaged within their holes 54, the fins 50 do not occupy the space defined by the counter sunk hole 56. Each fin 50 seals off the corresponding counter sunk hole 56. If the fins 50 are formed in a single, continuous, spiral screw thread-like arrangement, then the hole 54 and its counter sunk extension 56 both comprise a single spiraling hole that matches the screw thread-like arrangement of the fins 50.

FIG. 3 shows an inlet 58 for a working fluid to enter the right hand end portion 48 of the Qu-type heat pipe 40. The working fluid then flows in a spiraling manner though the counter sunk hole 56 after which it exits the right hand end portion 48 of the heat pipe 40 as a vapor through an outlet 60. In operation, as the waste heat travels through the ductwork 44, it heats up the left hand end portion 42 of the heat pipe 40 protrudes into the ductwork 44. As described hereinabove, the heat pipe 40 then transfers the heat to the right hand end portion 48 of the heat pipe 40. The transferred heat heats the working fluid traveling through the counter sunk hole 56 in a spiraling manner thereby causing the working fluid to evaporate and resulting in a vapor exiting the outlet 60. Thus, in this embodiment, the heat pipe 40 functions as its own, independent evaporator, which, as in the embodiment of FIGS. 1-2, may be part of an overall Rankine cycle system.

Figure 5:
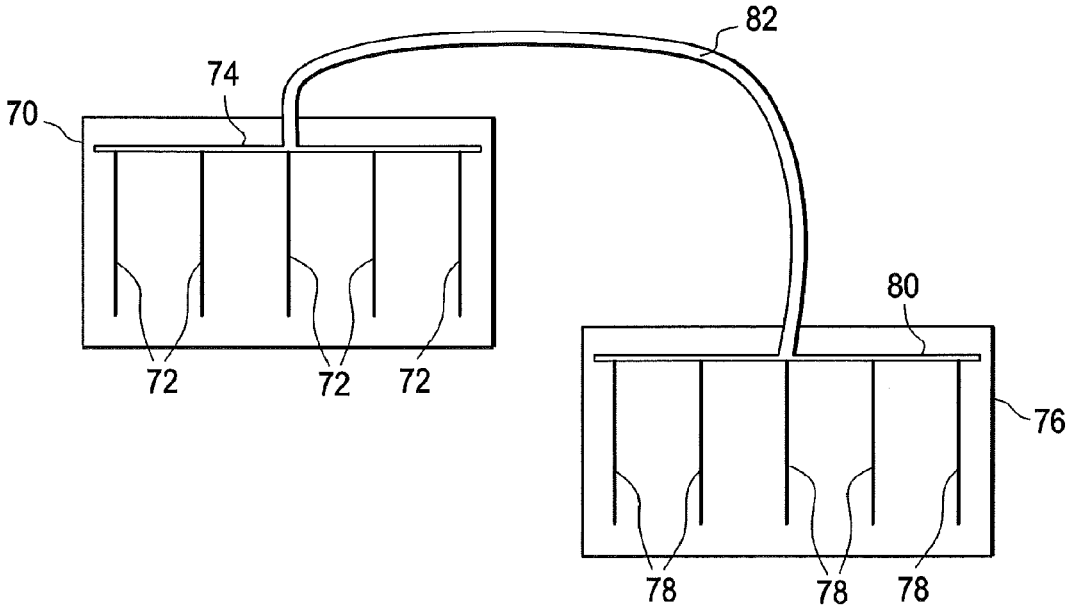
FIG. 5 is a schematic diagram of an arrangement of Qu-type heat pipes separated from an evaporator connected thereto by a connector Qu-type heat pipe according to an embodiment of the invention.

In FIG. 5 is an embodiment in which a first arrangement 70 of a plurality of Qu-type heat pipes 72 connected together by a header 74 connects with a second arrangement 76 of a plurality of Qu-type heat pipes 78 also connected together by a header 80. The first and second arrangements 70, 76 of heat pipes 72, 78 are connected together by a Qu-type heat pipe 82, which attaches at each end to the corresponding header 74, 80.

In this embodiment, the first arrangement 70 of Qu-type heat pipes 72 may be positioned in the ductwork or hot gas path of a waste heat source and act as a heat source. The heat pipes 72 absorb or extract energy from the relatively hot gas, which is collected by the header 74. The Qu-type heat pipe connector 82 may be insulated and is used to transfer this absorbed or extracted heat energy to the header 80 of the second arrangement 76 of heat pipes 78, which function as an evaporator (e.g., an organic Rankine cycle system evaporator) to evaporate the transferred heat. The first and second arrangements 70, 76 may be separated by a relatively large distance (e.g., greater than 100 meters). This allows the evaporator to be located at a relatively long distance from the waste heat source. Also, FIG. 5 shows that the Qu-type heat pipe connector 82 may be curved, and the connector 82 may also facilitate the first arrangement 70 of heat pipes 72 to be at a higher or different elevation from that of the second arrangement 76 or evaporator. The evaporator 76 may be a part of a larger overall Rankine cycle system.

Embodiments of the invention provide for the extraction of heat from a hot gas path that avoids the risks inherent in placement of organic Rankine cycle working fluid evaporators in the hot gas path and the costs of the indirect hot oil loops, as in the prior art. Embodiments of the invention use thermal energy of exhaust gas from a waste heat source and Qu-type heat pipes to transfer heat to an organic Rankine cycle working fluid evaporator. Qu-type heat pipes have relatively high axial thermal conductivities and can be used to transfer heat effectively without a fluid flow loop.

In other embodiments, the heat pipe organic Rankine cycle evaporator can be placed at a remote location separated from the heat source. This accomplished by using a heat pipe array to absorb energy from the hot gas. A relatively large insulated Qu-type heat pipe may then be used to transfer the heat over a relatively large distance to the heat pipe organic Rankine cycle evaporator (e.g., greater than 100 meters away from the source).

Using embodiments of the invention, heat is transferred using Qu-type heat pipes directly to the evaporator for the organic working fluid, which is external to the hot gas path. Both cost and weight are relatively less than having both a separate hot oil loop and an external evaporator. Other technical advantages of embodiments of the invention include savings in capital cost versus use of hot oil loop, an improved EHS profile versus direct placement of the evaporator in the hot gas path, a relatively smaller system footprint, and flexibility in the location of the organic Rankine cycle working fluid evaporator within the overall system.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An apparatus for delivering heat to an Organic Rankine Cycle, comprising:

a plurality of Qu-type heat pipes including a first portion disposed in a hot gas path of a heat source, the plurality of Qu-type heat pipes configured to extract heat from the hot gas path;

an evaporator disposed away from the heat source and including a plurality of Qu-type heat pipes, the evaporator being part of an Organic Rankine Cycle system; and a connector Qu-type heat pipe that connects the plurality of Qu-type heat pipes at the heat source with the second plurality of Qu-type heat pipes at the evaporator of the Organic Rankine Cycle system, wherein the connector Qu-type heat pipe transfers the extracted heat from the heat source to the evaporator of the Organic Rankine cycle system.

2. The apparatus of claim 1, wherein the plurality of Qu-type heat pipes in the heat source connect with a header in the heat source, wherein the plurality of Qu-type heat pipes in the evaporator connect with a header in the evaporator.

3. The apparatus of claim 1, wherein the connector Qu-type heat pipe connects at one end to the heat source header and at another end to the evaporator header.

4. The apparatus of claim 1, wherein the heat source is disposed at a different elevation than that of the evaporator.

5. A heat pipe evaporator, comprising:

a Qu-type heat pipe;

a first portion of the Qu-type heat pipe disposed in a hot gas path; and a second portion of a Qu-type heat pipe disposed away from the hot gas path, the second portion of the Qu-type heat pipe including a plurality of fins connected with the second portion of the Qu-type heat pipe; and a cover having holes formed therein, each hole including an extension region;

wherein the Qu-type heat pipe extracts heat from the hot gas path and creates a vapor at the second portion of the Qu-type heat pipe away from the hot gas path;

wherein an outer portion of each fin is disposed next to the cover having corresponding holes wherein each hole receives a portion of each corresponding outer portion of each fin, wherein the extension region of each corresponding hole is not occupied by the corresponding fin through which a working fluid passes and becomes the vapor as it is heated by the second portion of the Qu-type heat pipe.

6. The heat pipe evaporator of claim 5, wherein the plurality of fins are in a staggered arrangement along a length of the second portion of the Qu-type heat pipe.

7. The heat pipe evaporator of claim 5, wherein the working fluid is introduced at a first location along the staggered fin arrangement and wherein the vapor is extracted from a second location along the staggered fin arrangement.

8. The heat pipe evaporator of claim 5, wherein the plurality of fins are formed in a single, continuous spiral screw configuration along a length of the second portion of the Qu-type heat pipe, and wherein the holes comprise a single, continuous spiral hole that receives a portion of the single, continuous spiral fin.

9. The heat pipe evaporator of claim 5, wherein the heat pipe evaporator is part of an organic Rankine cycle system.

10. Apparatus for extracting heat, comprising a heat source having a plurality of Qu-type heat pipes arranged in a hot gas path of a waste heat source, wherein a first portion of each of the plurality of Qu-type heat pipes extracts heat from the hot gas path;

an evaporator disposed apart from the heat source, wherein the evaporator comprises a plurality of Qu-type heat pipes; and a connector Qu-type heat pipe that connects the plurality of Qu-type heat pipes at the heat source with the plurality of Qu-type heat pipes at the evaporator, wherein the connector Qu-type heat pipe transfers the extracted heat from the heat source to the evaporator for evaporation thereby.

11. The apparatus of claim 10, wherein the plurality of Qu-type heat pipes in the heat source connect with a header in the heat source, wherein the plurality of Qu-type heat pipes in the evaporator connect with a header in the evaporator.

12. The apparatus of claim 11, wherein the connector Qu-type heat pipe connects at one end to the heat source header and at another end to the evaporator header.

13. The apparatus of claim 10, wherein the heat source is disposed at a different elevation than that of the evaporator.

14. The apparatus of claim 10, wherein the apparatus is part of an organic Rankine cycle system.

* * * * *